US009303374B2

(12) United States Patent
Oberkofler et al.

(10) Patent No.: US 9,303,374 B2
(45) Date of Patent: Apr. 5, 2016

(54) JOINT DEVICE FOR RETAINING A SIGN POST

(71) Applicants: Peter Oberkofler, Sarnthein (IT); Sascha Hofer, Sarnthein (IT)

(72) Inventors: Peter Oberkofler, Sarnthein (IT); Sascha Hofer, Sarnthein (IT)

( * ) Notice: Subject to any disclaimer, the term of this patent is extended or adjusted under 35 U.S.C. 154(b) by 0 days.

(21) Appl. No.: 14/592,457

(22) Filed: Jan. 8, 2015

(65) Prior Publication Data

US 2015/0121733 A1 May 7, 2015

Related U.S. Application Data

(63) Continuation of application No. 14/474,881, filed on Sep. 2, 2014, now abandoned, which is a continuation of application No. PCT/EP2013/054653, filed on Mar. 7, 2013.

(30) Foreign Application Priority Data

Mar. 9, 2012 (IT) ..... VR2012A0040

(51) Int. Cl.
*E01F 9/017* (2006.01)
*E01F 9/011* (2006.01)

(52) U.S. Cl.
CPC ..... *E01F 9/0175* (2013.01); *E01F 9/0114* (2013.01); *E01F 9/0118* (2013.01)

(58) Field of Classification Search
CPC ..... E01F 9/0175; E01F 9/017; Y10S 248/90
See application file for complete search history.

(56) References Cited

U.S. PATENT DOCUMENTS

| | | | | | |
|---|---|---|---|---|---|
| 1,679,623 | A | * | 8/1928 | Olsen | 40/608 |
| 2,164,680 | A | * | 7/1939 | Donovan | 40/608 |
| 4,106,879 | A | * | 8/1978 | Diedershagen et al. | 404/10 |
| 4,270,873 | A | * | 6/1981 | Laehy et al. | 404/10 |
| 4,565,466 | A | * | 1/1986 | Daggs et al. | 404/10 |
| 4,588,324 | A | * | 5/1986 | Goellner | 404/10 |
| 4,636,109 | A | * | 1/1987 | Clausen et al. | 404/10 |
| 4,729,690 | A | * | 3/1988 | Lavender et al. | 404/10 |
| 4,806,046 | A | * | 2/1989 | Clark | 404/10 |
| 5,207,175 | A | | 5/1993 | Andonian | |
| 5,397,197 | A | * | 3/1995 | Beavers | 404/10 |
| 6,149,340 | A | * | 11/2000 | Pateman | 404/10 |
| 8,613,412 | B1 | * | 12/2013 | Donaldson | 248/156 |
| 2008/0067299 | A1 | | 3/2008 | Ebel et al. | |

(Continued)

FOREIGN PATENT DOCUMENTS

| | | |
|---|---|---|
| AU | 4343668 | 3/1970 |
| AU | 766749 B2 | 5/2000 |

(Continued)

*Primary Examiner* — Shin Kim
(74) *Attorney, Agent, or Firm* — Myers Wolin, LLC

(57) ABSTRACT

The present invention relates to a joint device (9) for mounting a sign post (95) or the like, comprising a first member (1) being connectable to a basis (99), and a second member (2) being connectable to a base portion (96*a*) of the sign post (95). A linkage (3) connects the first member (1) to the second member (2) such that the second member (2) is movable with respect to the first member (1) between an alignment position and a tilting position. A restoring means (4) which comprises an elastic element (40) and a deforming element (45) for cooperation with the elastic element (40) returns the two members (1, 2) towards the alignment position. The elastic element (40) is received in an interior pipe storage space (25) which is recessed in the first member (1) and the second member (2).

28 Claims, 6 Drawing Sheets

(56) References Cited

U.S. PATENT DOCUMENTS

2010/0266337 A1* 10/2010 Lapointe et al. ..... 404/11
2010/0277290 A1* 11/2010 Knudsen ..... 340/10.52

FOREIGN PATENT DOCUMENTS

DE 8607898 U1 5/1986
EP 0112804 A2 7/1984

* cited by examiner

JOINT DEVICE FOR RETAINING A SIGN POST

CROSS REFERENCE TO RELATED APPLICATIONS

The present application is a continuation of U.S. application Ser. No. 14/474,881, filed on Sep. 2, 2014, which is a continuation of International Application No. PCT/EP2013/054653, filed on Mar. 7, 2013, which claims priority to Italian Patent Application No. VR 2012 A 000040, filed on Mar. 9, 2012, the contents of each of which are incorporated herein by reference.

FIELD OF THE INVENTION

The present invention generally relates to the field of road equipment or the like. In particular, it relates to a mounting device for a sign post or similar post which, for example, is set up vertically from the ground or within the remote or immediate area of a road, a parking lot, or a pathway.

BACKGROUND OF THE INVENTION AND PRIOR ART

Traffic signs usually are attached to mounting posts which are rammed into the ground, into a street, or sidewalk. Frequently, such posts (in the following referred to as "sign posts") are hit by vehicles, for example, during a parking maneuver of a vehicle in the vicinity of a sign post, or due to an accident or loss of control of a vehicle nearby a sign post. Due to the impact of the vehicle, the post is damaged and deformed wherein it remains broken and no longer allows for an unobstructed view of the traffic sign; due to a particularly strong impact, the post may virtually shatter.

The governing authority for traffic signs, for example, a municipal administration responsible for roads, therefore, has to spend substantial costs for monitoring, maintenance of the damaged sign posts, and the complete replacement of the posts which have been broken or have been bent beyond a certain range of tolerance.

According to several solutions from prior art, this problem is encountered by subdividing the sign posts nearby its basis into two portions, and to unite both portions by means of a coil spring which is arranged outside of the two portions. The coil spring functions as linking member between the two portions and allows for flexibility of the post which in case of an impact is tilted elastically, and then returns to its vertical position. Such solutions are, for example, known from US 2008/0067299 A1 or from U.S. Pat. No. 5,207,175.

A first disadvantage associated with these solutions lies therein that the external coil spring due to its technically inherent features is not able to sufficiently stabilize the sign post in normal circumstances. For example, a post having a height of 3 meters including the traffic sign which is attached to the upper end has a weight and torque exerted by wind being greater than may be compensated by the coil spring. Such a sign post in normal circumstances has little stability, sways continuously, and may be inclined by the pressure of wind substantially.

Moreover, in case the post is damaged, it is necessary to remove the entire post including its base, and a new post has to be erected by also renewing the basis. Such sign posts made from two portions and having a coil spring connection have to be completely assembled in the workshop, and therefore, on the road, it is not possible to only replace the upper portion and to leave the basis unaffected.

A second disadvantage, therefore, is associated with the costs and the complexity of the maintenance of the sign posts which are provided with an exterior coil spring. An additional fact which adds on the latter is that the external coil spring may be exposed to damage and may have an unaesthetic appearance.

From AU 43436 A, a post pedestal is known having a base plate at the upper side of which a reset ring is arranged. The reset ring engages a lower opening of a pipe being arranged perpendicular to the base plate at the upper end of which a sign post is attached. A U-shaped bolt is arranged within the reset ring and the upper side of the base plate which engages with an eyebolt wherein the eyebolt protrudes into the interior of the pipe. A coil spring is arranged at the eyebolt which is to exert a certain reset force such that the pipe returns to its upright position.

This solution is disadvantageous in that due to the arrangement of the U-shaped bolt and the eyebolt with respect to each other, the pipe may no longer be tilted in all directions. A tilting of the pipe obliquely to the U-shaped bolt may even lead to the U-shaped bolt or the eyebolt being deformed or even damaged.

From EP 0112804 A2, a traffic post is known which after having been tilted should erect itself again autonomously. In a first embodiment, an elastic rubber tube is arranged in the pipe interior in the area of the joint which exerts a certain reset force. In a second embodiment, a coil spring is arranged in the upper part of the pipe which is formed in two pieces which is coupled to a rope. The rope is guided in a guidance gap in a lower part of the pipe, is deflected there at a deflection disk, and is guided in a further guidance gap back to the upper part of the pipe. A similar traffic post is also known from AU 766749 B2.

From DE 86 07 898 U, a barrier device for parking lots is known. The barrier device has a pedestal with a post arranged thereon which is tiltable on the pedestal. In the interior of the post, a coil spring is arranged which is to exert a certain reset force when the post is tilted such that the post returns to its upright position again.

OBJECT OF THE INVENTION

Therefore, the present invention is based on the technical problem to provide a mounting device of a sign post or the like which allows for overcoming the disadvantages mentioned above with reference to the prior art and/or to achieve further advantages, in particular, to provide a constructively simple and stable joint device for mounting a sign post.

Solution According to the Invention

According to the invention, this problem is solved by a joint device, a system, a sign means as well as a method according to the independent claims.

Preferred embodiments of the subject-matter of the present invention are defined in the dependent claims.

The joint device according to the present invention is suitable for configuring an elastically flexible sign means at which no external spring is visible. This has the advantage that a specifically aesthetic sign means may be provided which, moreover, exhibits a high resistance to weather and does not pose an additional danger.

Moreover, it is convenient in order to implement a flexible sign means with substantial stability, and that in normal circumstances, the sign means remains essentially immobile wherein it only deforms under the influence of a substantial force, for example, an impact by a vehicle.

The joint device according to the invention also is advantageous to implement a flexible sign means which allows for a quick disassembly or a quick replacement of the sign post as needed without the basis for the post having to be removed or dismantled.

The joint device may moreover be implemented with common, i.e., non-flexible sign posts which already have been set up in order to simply modify them to flexible sign means having the advantage of high cost savings for the future maintenance.

Basically, the joint device is intended for being interposed between a sign post and a pedestal. For example, the pedestal is a pipe or post portion, which is fixed to the ground or has been cemented, and which projects from the ground plane, or which is flush with the latter.

The joint device comprises a first member and a second member each of which being designated for being fixed to the basis or at the post. The first member and the second member are connected to each other via a linkage which allows for a bending or tilting (angular/inclined relative movement) of the second member with respect to the first member. An elastic system brings the two members back towards the direction to the non-bent or non-tilted position.

In normal circumstances, the two members, therefore, are in a non-bent or non-tilted position (also referred to as original orientation of the members) and the sign post remains vertical and/or aligned with the basis. In case a force greater than a certain minimum force acts on the sign post, then the two members bend or tilt or move/rotate with respect to each other wherein the change of inclination of the post with respect to the basis is allowed. In case the exterior force is no longer applied, then the elastic system brings the post back into the vertical initial position.

The elastic system is calibrated such that the sing post in normal circumstances remains stable, for example, under the influence of wind or a person which leans against the post, and the bending or tilting of the post is allowed under the influence of a substantial force prior to the post being damaged. In other words, the elastic system is calibrated to allow the tilting of the post in the region of a force being applied which is below a force which may plastically deform or damage the post. Basically, the sign post may perform a reversible bending or reversible tilting.

In particular, the elastic system comprises an elastically deformable element and a deformable element which deforms the elastic member during the movement from the bending or tilting of the two members. During the reverse movement, the deforming element is returned to its initial position.

For example, the elastic element is linked to either one of the two members and the deforming element is linked to either one of the two members: the change of inclination between the two members effects a mutual displacement between the elastic element and the deforming element, and, therefore, an interaction between these two latter elements which results in an elastic deformation of the elastic element and in a subsequent restoring force. The elastic system with the elastic element/deforming element allows an excellent stability of the post and an adjustability of the force necessary for the bending or for the tilting. For example, the joint device may be configured such that the elastic element is biased, i.e., the elastic element has a stored spring energy (and therefore a biasing force to be overcome), even if the two members are in a non-bent or non-tilted position with respect to each other.

The elastic system is received within either one of the two members which has a tubular shape with an interior storage space for the elastic system. The elastic system, therefore, is physically protected by the pipe member, and therefore, besides achieving an aesthetical advantage, the problems of dirt accumulation and wear due to influences of weather are essentially resolved.

In an embodiment, the elastic element is loaded by pressure during bending of the joint device. This is expedient in order to obtain a more stable device against undesired oscillations, and according to which a highest inclination limit is obtained in a simple manner within the region of the highest pressure which the elastic element may be subjected to.

In an embodiment, the elastic element is a disk spring. This is advantageous for implementing a joint device which is able to offer a very high restoring force in a very delimited space as is the storage space within the pipe member. The disk spring may, for example, develop a force of 10 kN to 100 kN, preferably of 25 kN to 50 kN wherein at the same time, it may be arranged within a pipe member having a diameter of a common sign post. This is advantageous for obtaining a sign means, e.g., having a height of 3 m which in normal circumstances is vertically stable, and, e.g., may be bent upon an impact of a vehicle up to 35° wherein it then returns to its vertical position after the impact.

The elastic element may also comprise a number of disk spring packages which are connected in series wherein the disk spring package consists of at least two mutually arranged disk springs.

In an embodiment, the connection between the two members is according to the type of "multiple direction", i.e., it forms a hinge which allows for bending or tilting in all directions. In other words, the connection is a hinge with cylindrical symmetry with respect to the axis of the sign post. This is advantageous for obtaining a sign means which behaves uniformly, independent of the direction from which the impact results.

In an embodiment, the linkage may be implemented as a chain having at least two chain members. In a preferred embodiment, the chain has exactly two chain members whereby a first chain member is connected to the first member of the joint device and a second chain member is connected to the elastically deformable element. In the following, the chain members are referred to as rings whereby the rings do not necessarily have to have a circular shape. Preferably, the chain members or rings have an oval or elongated shape.

In particular embodiments, the joint device comprises connection accessories which are fixable on the sign post or at the basis via tapered straddling means or other connection means. Each connection accessory, moreover, is connectable at the first or at the second member, for example, by screwing. Thereby, the fixing and the erection of the joint device and the sign post may be facilitated. After the connection accessories respectively have been fixed to the basis and at the sign post, the joint device is interposed between the latter (i.e., between the connection accessories) and is screwed by performing the fixation. Also bayonet closures or plug connections with bolts may be provided for fixation.

In an embodiment of the invention, also a predetermined breaking point may be provided. Preferably, an intermediate piece is provided which has a predetermined breaking point and which is arranged between the connection accessories and the first member or the second member.

With this type of set up, the joint device remains outside of the ground. This has the advantage to further protect the joint and the elastic system from dirt (for example, from mud, soil, sand) which may impede the efficiency as well as to also facilitate the maintenance and a possible removal of the joint device. Should it be necessary for any reason to dismantle the sign means and to remove the joint device, this may be achieved without affecting the basis and/or having to carry out any digging.

In an embodiment, the joint device has the same external diameter as the sign post in which it is mounted, having the advantage that no visual disturbance exists between the post and its basis.

In an embodiment of the invention, the joint device has an anti-turn locking device. The anti-turn locking device ensures that during tilting up, the second member of the joint device always returns into its original position with respect to the first member, even if the second member rotates around its longitudinal axis during tilting. Hereby, the lower end of the second member may be configured in a slightly undulated manner. The upper end of the first member may also be configured slightly undulated, preferably such that the two undulated ends correspond to each other in an upright position of the joint device or engage each other.

In an embodiment of the invention, for fixing the first member to the basis between the first member and the connection accessory, an intermediate piece may be provided by means of which the first member is connected to the connection accessory, for example, by means of screwing, and which has the predetermined breaking point. By this it is avoided that the joint device is damaged due to overstrong impacting forces. In case a certain force is exceeded, the intermediate piece breaks at the predetermined breaking point such that the remaining components of the joint device remain essentially unimpaired, and only the intermediate piece has to be replaced.

BRIEF DESCRIPTION OF THE FIGURES

Further advantages, features and application possibilities of the subject-matter of the present invention can be clearly derived from the following detailed description of a preferred embodiment which is shown in an exemplary and non-delimiting manner.

However, it is clear that each embodiment of the subject-matter of the present invention may have one or more of the advantages mentioned above; in any event, it is not necessary that each embodiment has to have all of the advantages mentioned above simultaneously.

It is referred to the figures of the accompanying drawing in which

Figure 1:
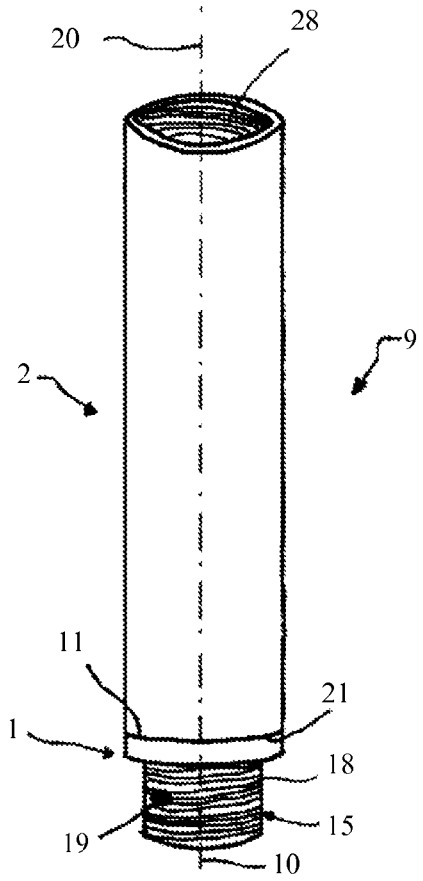
Figure 4:
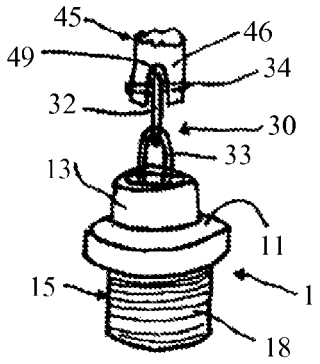
Figure 5:
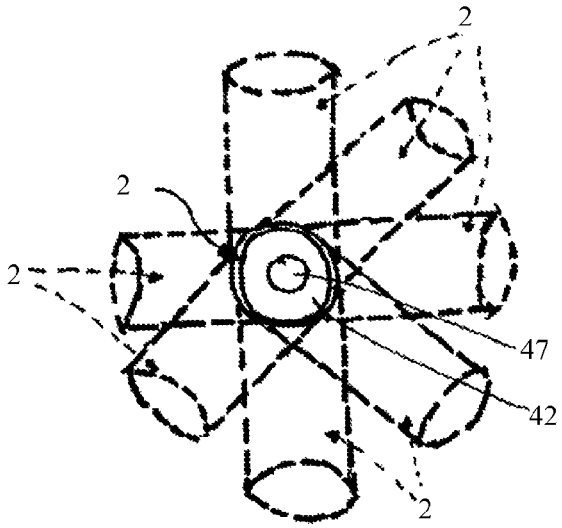
Figure 2:
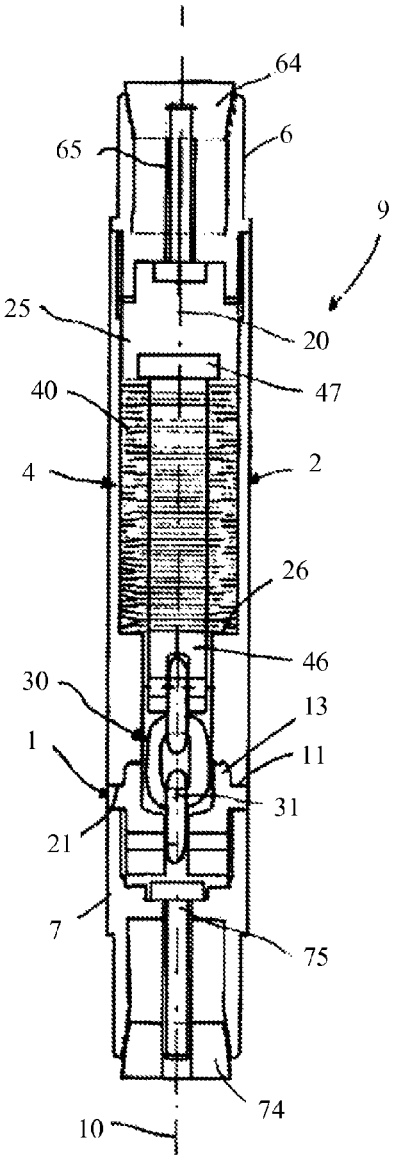
Figure 3:
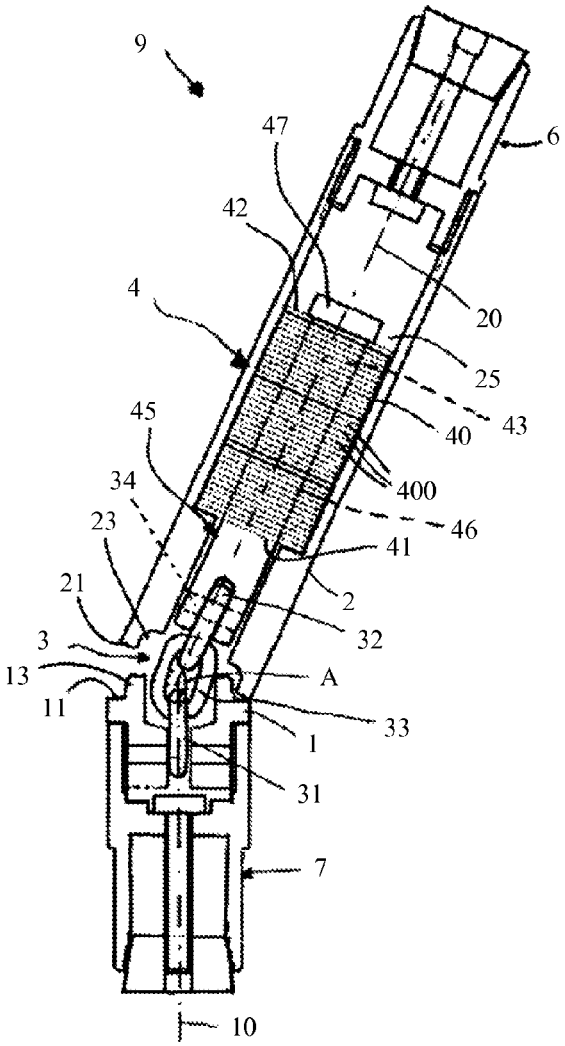
Figure 6:
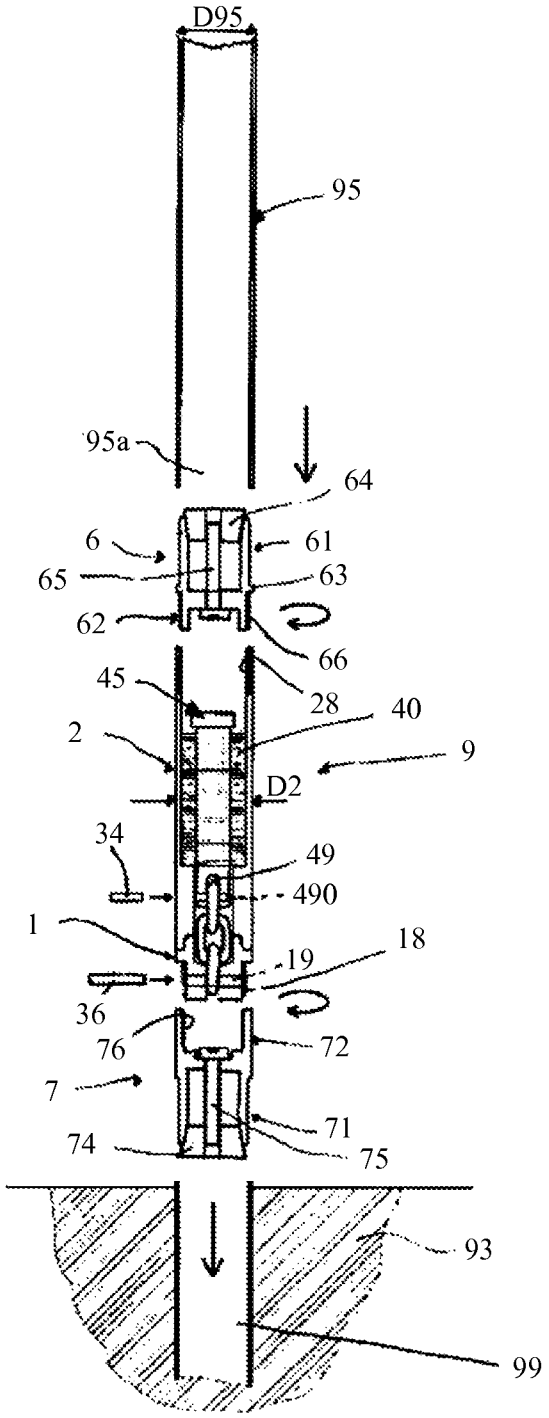
Figure 7:
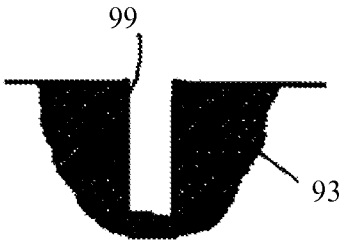
Figure 8:
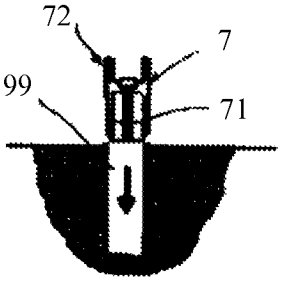
Figure 9:
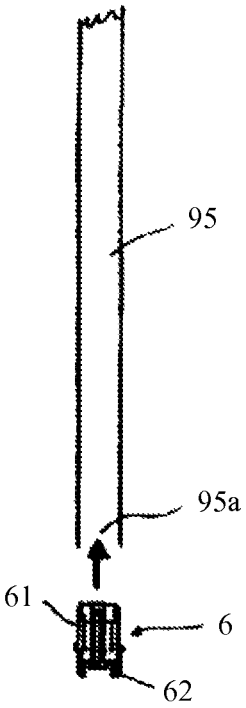
Figure 10:
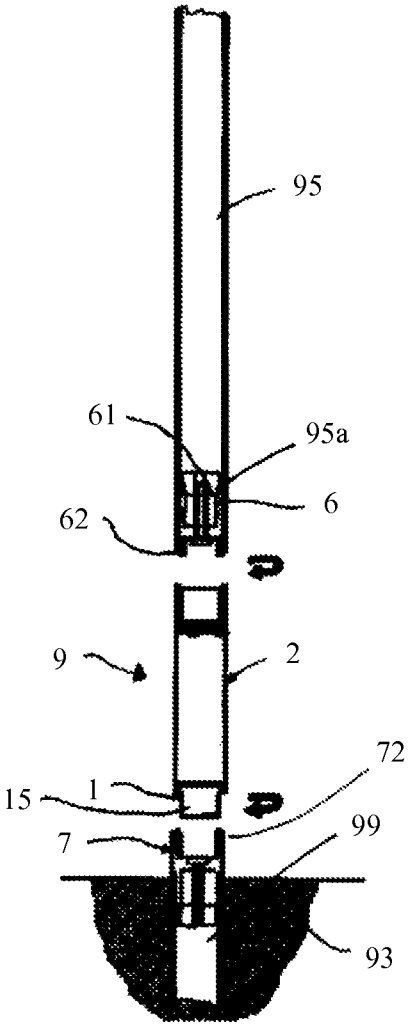
Figure 11:
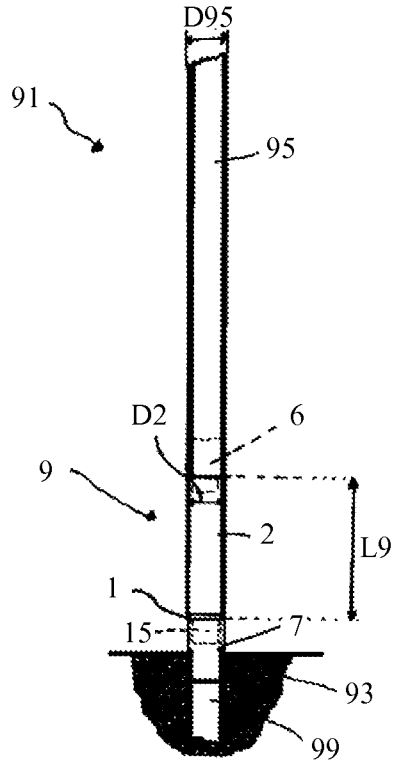
Figure 13:
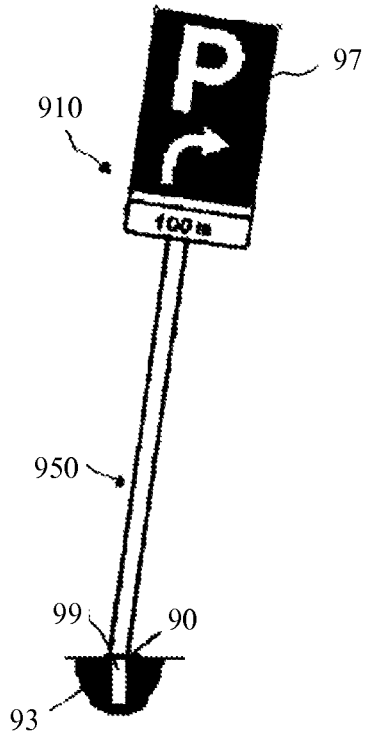
Figure 12:
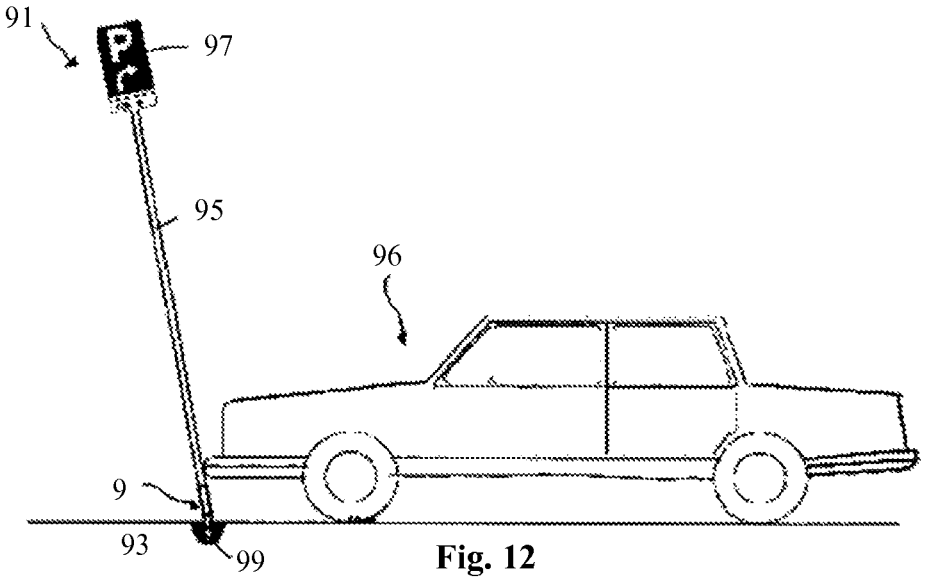
Figure 14:
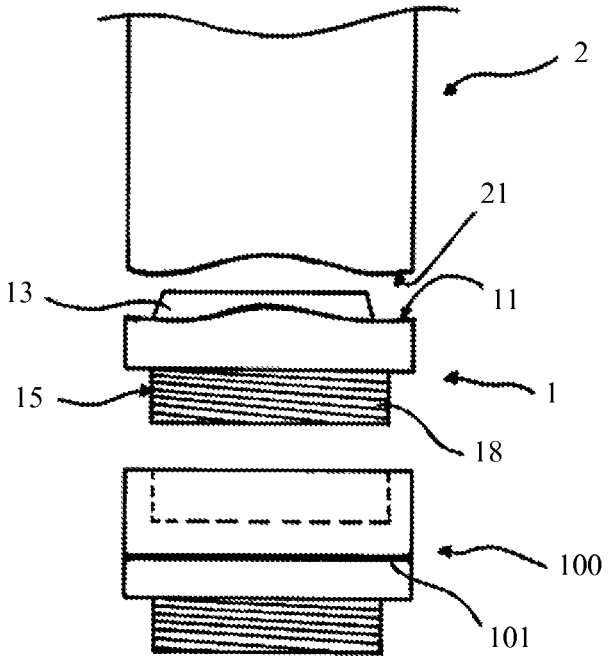
Figure 15:
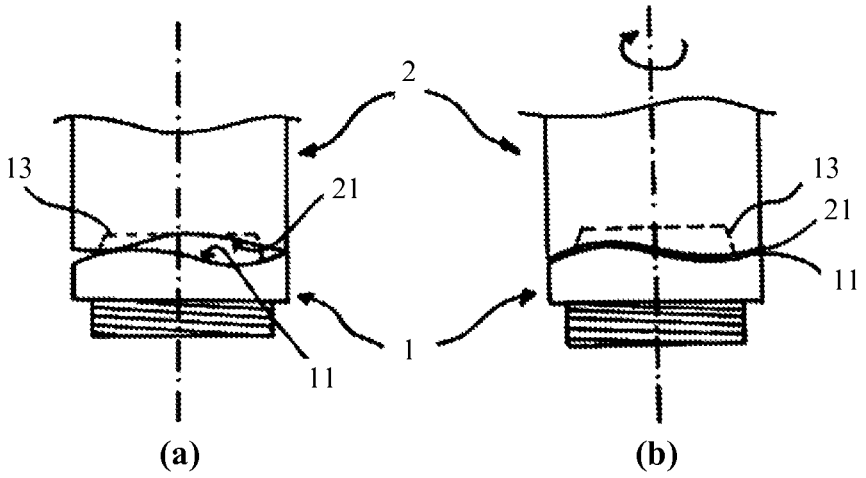

FIG. 1 represents a view of the joint device according to the present invention;

FIG. 2 represents a sectional view of the joint device of FIG. 1 in a first angular position;

FIG. 3 represents a sectional view of the joint device of FIG. 1 in a second angular position:

FIG. 4 represents a view, partially broken, of a component of the joint device of FIG. 1;

FIG. 5 represents a plan view of the joint device of FIG. 1 in the first angular position and with broken lines within a plurality of second angular positions;

FIG. 6 represents a sectional view of a sign means which illustrates a joint device of FIG. 1 showing a mounting step;

FIG. 7-10 represent subsequent mounting steps of a sign means comprising the joint device of FIG. 1;

FIG. 11 represents a side view, partially broken, of a sign means which comprises the joint device of FIG. 1 in a vertical position:

FIG. 12 represents a side view of the sign means of FIG. 11 in a tilted position:

FIG. 13 represents a step of a method to design a sign means of a known type reversibly flexible;

FIG. 14 represents a side view of the joint device of FIG. 1 with an intermediate piece; and FIG. 15 represents the joint device from FIG. 14 wherein the second member is rotated by a certain angle with respect to the first member (a), and wherein the second member corresponds to the first member with respect to the rotation angle.

DETAILED DESCRIPTION OF THE INVENTION

Referring to the accompanying figures, a joint device according to the present invention is indicated by the reference numeral 9. The joint device 9 is configured so as to hold or support a sign post or the like, e.g., a post 95 which is provided with a sign or a traffic sign 97. In use, the joint device 9 is arranged between the sign post 95 and a pedestal or basis 99.

In the example, the basis 99 is a pipe or post portion which is attached to the ground 93 and forms a basis to which the sign post 95 is fixed via the joint device 9. The ground 93 may be, e.g., soil, a street, a sidewalk, a place or generally a location where the attachment of a sign post 95 is required. The basis 99, for example, is a pipe portion which preferably has the same diameter as the sign post 95 and which is cemented into the ground 93.

As is illustrated in the figures, the basis 99 is at least partially dug or cemented into the ground 93, and may specifically project from the surface of the ground 93 slightly wherein the latter, however, is not compulsory.

The joint device 9 comprises a first member 1 and a second member 2 which are connected to each other by means of a linkage 3. In particular, the first member 1 is designated for being connected to the basis 99, and, therefore, is a basic member of the joint device 9, while the second member is designated for being connected to the sign post 95 (in the specific case, at a base portion 95*a*), and, therefore, is an upper member of the joint device 9.

In the embodiment shown, the first member 1 and the second member 2 have a substantially tubular shape with circular cross section, and consist of metal, for example, of steel. Other stable materials may also be used.

Owing to the linkage 3, which in the following will be described in further detail, the second member 2 can change its inclination with respect to the first member 2 such that a certain degree of flexibility (range of inclination/tilting/movement) of the joint device 9 is enabled. The first member 1 and the second member 2 are movable with respect to each other between a first angular position and a second angular position.

In the first angular position, as shown in FIG. 2, the second member 2 essentially is aligned to the first member 1. i.e., their respective longitudinal axes 20, 10 are parallel to each other or coincide. In the second angular position, as can be seen in FIG. 3, the second member 2 is bent or is tilted or inclined with respect to the first member 1, i.e., their respective longitudinal axes 20, 10 are positioned in an angle A with respect to each other. The bending of the joint device 9 basically is a relative pivoting, tilting and/or rotation between the two members 1, 2 about an axis or hinge axis or center of rotation set by the linkage 3.

In particular the linkage 3 is designed according to the type of a "multiple direction linkage", i.e., it allows for tilting the members 1, 2 with respect to each other in a plurality of directions about 360° in a horizontal section. For example, FIG. 5 shows a top view of the joint device 9, the second member 2 being indicated by broken lines tilted in a plurality of different directions. Basically, the linkage 3 forms a hinge between the first member 1 and the second member 2 wherein the hinge has an essentially cylindrical symmetry with respect to the longitudinal axis 10 of the first member 1. I.e., the hinge essentially is rotationally symmetric with respect to its longitudinal axis.

In the embodiment shown, the linkage 3 comprises a chain 30 with a plurality of rings or chain members being connected to each other in series: a first ring or chain member 31 is connected to the first member 1 and a second ring or chain member 32 is connected to the second member 2. In the embodiment shown, the chain 30 comprises three rings or chain members and a third ring or chain member 33 is interposed between the first ring or chain member 31 and the second ring or chain member 32. In a preferred embodiment, a chain 30 having exactly two rings or chain members 31, 32 is provided. In another embodiment, also more than two chain members may be provided.

The chain 30 delimits the distance between the first member 1 and the second member 2 from each other, but, however, still allows the members a tilting with respect to each other without binding these to a specific tilting direction: the chain 30, therefore, forms a joint in several directions about 360°.

Instead of the chain, also a rope, for example, a steel rope, or a universal or cardan joint may be provided. The use of the chain, however, has been found to be especially advantageous.

The first member 1 has a ring face 11 at the upper end which forms a support and stop for a bottom pipe end 21 of the second member 2; in the first angular position, the pipe end 21 rests on the ring face 11 longitudinally along the entire circumference while in the second angular position, only a limited portion of the pipe end 21 rests on a corresponding limiting portion of the ring face 11. For the purpose of an anti-rotation locking device, the ring face 11 and the pipe end 21 basically may be designed in an undulating manner, as is shown with reference to FIG. 14 and FIG. 15.

The first member 1, moreover, comprises a pipe projection 13 which projects from the ring face 11 and has a diameter which is smaller than the diameter of the ring face 11. The projection 13 has a shape that essentially is complementary to the recess 23 which is recessed in the bottom of the second member 2. In the first angular position in which the first member 1 and the second member 2 are aligned to each other, the projection 13 is received in the recess 23 and prevents, owing to the mutual complementarity, mutual movements between the members 1 and 2 in a transverse direction to the longitudinal axes 10, 20. In other words, a transverse displacement between the first member 1 and the second member 2 is prevented by the overlap between the projection 13 and the side wall of the recess 23. The projection 13 has a tapered or rounded shape in an upwards direction in order to allow for a tilting towards the second angular position without overlapping the recess 23.

The joint device 9, moreover, comprises a restoring means 4 which is configured to force and to restore the first member 1 and the second member 2 towards the first angular position, i.e., towards the aligned arrangement. The restoring means 4 comprises an elastic element which for example is a disk spring 40, and a deforming element, which e.g., is a slider or a piston 45. In a preferred embodiment of the invention, the elastic element comprises a plurality of disk spring packages which are connected to each other in series wherein a disk spring package consists of at least two disk springs arranged mutually with respect to each other. The diameter of the disk springs or disk spring packages basically corresponds to the inner diameter of the second, i.e., the upper member 2.

The deforming element 45 cooperates with the elastic element 40 in order to deform the latter during a movement between the first angular position and the second angular position beyond the biasing force. In other words, if the joint device 9 is bent or tilted under the influence of an external force, then the elastic element 40 will be loaded additionally and exerts a restoring force which upon omission of the external force will bring the joint device 9 back into the rest position, i.e., into the non-bent or non-tilted position.

In the embodiment shown, the second member 2 (i.e., the upper member which is connectable to the sign post 95) has a substantially tubular shape defining an interior storage space 25 in order to receive the elastic element 40.

In particular, the deformation of the elastic element 40 is a compression, i.e., the elastic element 40 is further compressed as soon as the members 1 and 2 are in the second bending angle position with respect to a rest position, or is less compressed as soon as the members 1 and 2 are in a first aligned angular position.

The elastic element may be, e.g., a coil spring or may be of another type of spring, in particular, a spring to which pressure is applicable. Tests, however, have shown that disk springs or disk spring packages are particularly well suited for the present invention. For applications in which far lower forces are applied, also coil springs or the like may be used.

In the embodiment shown, the elastic element 40 comprises a plurality of disk spring packages, i.e., it comprises a plurality of disk elements 400 lying one above the other and being elastically deformable (compression) under application of pressure. The disk elements 400 respectively have a central axial through-hole. The elastic element 40, therefore, has a first end 41 (or base end), a second end 42 (or upper end) opposing the first end 41, and a cavity 43 which extends continuously from the first end 41 to the second end 42. The continuous cavity 43 is formed by the central borings of the disk elements 400 which are aligned with respect to each other.

The storage space 25 within the second member 2 has a support area for the spring 40 which is formed by a collar 26 or a ring face or a projection protruding into the interior space of the second member 2. Thereby, the interior diameter within the upper region of the second member is larger than in the area of the collar 26. Further, the interior diameter of the second member in the region of the collar 26 is smaller than the exterior diameter of the first end 41 of the spring 40.

The deforming element basically is a piston valve 45 with a shaft 46 and a head 47 having a width or a diameter larger than the shaft 46. The shaft 46 is displaceably received within the continuous cavity 43 of the spring 40, while the head 47 owing to its larger transverse dimensions (which are even larger than the diameter of the continuous cavity 43) rests upon the second end 42 of the spring 40. In other words, the head 47 presses against the second end 42 of the spring 40 and the shaft 46 passes through the cavity 43 and protrudes from the first end 41 of the spring 40. The diameter of the portion of the piston valve 45 protruding from the first end 41 of the spring 40 may be larger, smaller, or equal to the diameter of the continuous cavity 43.

The head and the shaft may be formed in one piece. In the embodiment shown here, the head 47 is connected to the shaft 47 releasably. The head 47 here is configured as a screw nut.

The shaft 46 is connected at the side projecting or protruding from the first end 41 to the second ring 32 of the chain 30. In particular, the protruding end of the shaft 46 has a groove 49 in order to at least partially receive the second ring 32 which is fixed to the shaft 46 via a bolt 34 which is fitted in a continuous boring 490 provided for this purpose. The bolt 34 when fitted into the continuous boring 490 passes through the groove 49 and the second ring 32 such that the second ring is held in the groove 49.

The chain 30 is inserted within the tubular protrusion 13 of the first member 1, and the first ring 31 of the chain 30 is fixed to the first member 1 via a continuous pin 36 which is inserted into a boring 19 provided for this purpose which is formed in the first member 1, in particular, in a bottom pipe portion 15. The pin 36 when inserted into the continuous boring 19 passes through the bottom pipe portion 15 and the first ring 31 such that the first ring is held within the pipe projection 13.

Basically, the chain 30 defines a maximum distance between the first member 1 and the valve 45 and is adjusted such that with partial compression of the disk spring 40, it is tensioned as soon as the joint device 9 is in the first angular position, i.e., the joint device 9 is biased in the first angular position in order to guarantee a certain stability of the supported sign post.

During bending, i.e., during the tilting movement towards the second angular position, the distance between the first member 1 and the second member 2 in the axial area (where the chain 30 is located) is increased, and the chain 30, therefore, applies a tensile force to the valve 45 by preventing the free displacement of the latter together with the spring 40. The members 1 and 2 always remain in contact such that during a tilting movement, the contact face will be a point contact. The virtual centers of gravity of the contact faces of the members 1 and 2 then do no longer coincide but rather depart from each other due to the relative tilting movement about a common contact point of the contact faces whereby the distances of this contact point to the respective axes 10, 20 do not necessarily have to be identical. i.e., the contact point of the upper joint slides inwards on the contact face, thus, towards axis 10.

The head 47, therefore, is pulled towards the collar 26 of the storage space 25, and further compresses the disk spring 40. In other words, the valve 45 performs a partial displacement within the cavity 43 of the spring 40 by being pulled towards the first member 1, and compresses the spring 40 towards the direction of the collar 26. As soon as the spring 40 achieves the highest maximum compression physically allowed by the disk elements 400, a further increase of the inclination is prevented and the system limits within which the joint operates reliably are reached, respectively.

In order to prevent that an even further inclination (beyond the allowed maximum compression), for example, during a collision with a vehicle with excessive speed, leads to damage of the joint device, the sign post, or the vehicle, an intermediate piece 100 may be provided which has a predetermined breaking point 101, as is shown with reference to FIG. 14. In case of damage, the intermediate piece 100 then will only be damaged such that also only the latter will have to be replaced, leading to a substantial cost and work reduction.

For example, the disk spring 40 is tensioned with a force of 25 kN (i.e., the disk spring or the disk spring packages are biased), if the members 1, 2 are in the first aligned angular position. The disk springs or disk spring packages may also be biased by a larger or smaller force than 25 kN ultimately depending from the required stability, weight, or length of the sign post to be supported.

The disk spring 40 is tensioned with a force of 50 kN as soon as the members 1, 2 are in a second bending angle position which, for example, corresponds to an inclination A of 35°. In the second bending angle position, the disk springs or disk spring packages may also be loaded by a larger or smaller force than 50 kN.

It should be understood that the effective inclination angle which both members 1, 2 achieve depends on the strength of the acting force, and therefore, is different as the case arises.

The joint device 9 is installed by using the fixation accessories which allow the connection to the sign post 95 and to the basis 99.

The first fixation accessory 6 has a first part 61 which may be connected to a base portion 95*a* of the sign post 95 or may be brought into engagement with the base portion 95*a* of the sign post 95, and a second part 62 which may be connected to the upper end of the second member 2 or may be brought into engagement with the upper end of the second member 2. The first fixation accessory 6 particularly has a cylindrical or rotation symmetric tubular shape. The legs of the first part 61 are tapered internally and provided with slots whereby the slots do not all have to be equally wide.

The first part 61 is a first end portion which is intended for being inserted within the end base part 95*a* of the sign post 95. The attachment to the sign post, for example, is carried out by a tapered straddling means 64 which is arranged in the first part 61, and which is adjustable via a screw 65 (for example, with an ISO threading M12), which is accessible from the side of the second part 62.

The second part 62 is a second end portion intended for being inserted within the upper end of the second member 2 of the joint device 9. The second part 62 is provided with an external threading 66, which engages with the upper end of the second member 2 which is formed at the upper end of the second member 2. The attachment of the first fixation accessory 6 at the joint device 9 is carried out by screwing the first accessory 6 into the second member 2.

The attachment of the first member 1 at the fixation accessory 6 may also in an alternative embodiment be implemented by a bayonet closure.

Between the first part 61 and the second part 62, there is a collar 63 having a diameter larger than the diameter of the two parts 61, 62. In particular, the diameter of the collar 63 is equal to the outer diameter of the second member 2 and the sign post 95.

A second fixation accessory 7 has a first part 71 which is connectable to the basis 99 and a second part 72 which is connectable at the bottom of the first member 1. The second fixation accessory 7, in particular, has a cylindrical or rotationally symmetric tubular shape. The legs of the part 71 internally are tapered and provided with slots whereby the slots do not have to be equally wide.

The first part 71 is a first end portion intended for being fixed within the basis 99. The attachment to the basis 99 is, e.g., carried out by a tapered straddling means 74 which is arranged at the first part 71 and which is adjustable by a screw 75 (for example with an ISO threading M12) which is accessible from the side of the second part 72.

The second part 72 is a second end portion intended for receiving the bottom of the first member 1 or the joint device 9. The second part 72 is provided with an internal threading 76 which engages with the external threading 18 of the first member 1 which is formed in the bottom pipe area 15 of the first member 1. The attachment of the second fixation accessory 7 at the joint device 9 is carried out by screwing the second accessory 7 at the first member 1.

The attachment of the first member 1 to the fixation accessory 7 in an alternative embodiment may also be implemented by a bayonet closure.

In particular, the second member 72 has a diameter equal to the external diameter of the second member 2 and the sign post 95. The first part 71 has a diameter smaller than the second part 72.

The configuration of a traffic sign means 91 according to the present invention will be described in the following.

The first fixation accessory 6 is attached at the bottom 95*a* of the sign post 95: the first part 61 of the accessory 6 is introduced into the bottom end of the post and the screw 65 is screwed resulting in clamping the tapered straddling means 64 which deforms the first part 61 in that locally, the diameter is increased such that the first part 61 is clamped within the sign post 95. The joint device 9 then is screwed to the first fixation accessory 6, i.e., the upper end of the second member 2 of the joint device 9 is screwed to the second part 62 of the accessory 6.

Thus, an entity or a system is obtained comprising the sign post 95 and the joint device 9 with the second member 2 which is fixedly connected to the base portion 95*a* of the sign post 95.

In particular, the joint device 9 has a cross section having a shape and external dimensions being equal to the shape and the external dimensions of the cross section of the sign post 95. In particular, the external diameter D2 of the second member 2 (having the tubular shape and forming the entire length of the joint device 9) is equal to the external diameter D95 of the sign post 95. The joint device 9 forms a continuity, also visually, with the sing post 95, and therefore, has no negative aesthetic effect. Also the ring face 11 of the first member 1 has an external diameter which is equal to the external diameter D2 of the second member 2.

For example, the diameter D2 is 60 mm and the length L9 of the joint device 9 during attachment is 300 mm. Of course, also other diameters and lengths of the joint device may be selected depending eventually on the concrete requirements to the joint device.

A basis 99 is formed in the desired area for the attachment of the sign post. For example, the basis 99 is a pipe portion which is installed and cemented in a street or at a side walk or generally, in the ground 93. In particular, the pipe portion 99 has the same diameter D95 as the sign post 95.

The pipe portion 99 slightly protrudes from the ground 93 or is flush to the latter.

A second fixation accessory 7 is fixed in the basis 99: the first part 71 of the accessory 7 is inserted into the basis 99, and the screw 75 is tightened. Similar as described with respect to the first accessory 6, the tapered straddling means 74 deforms the first part 71 by locally increasing the diameter of it and the fixation accessory 7 is clamped in the basis 99.

The second fixation accessory 7 itself also remains slightly protruding from the ground 93 or flush to the ground. As may be the case, the pipe portion 99 may be inserted into the ground 93 deeper whereby only the second fixation accessory 7 remains protruding.

The entity post 95/joint device 9 is screwed to the second fixation accessory 7, i.e., the bottom 15 of the first member 1 (and therefore the entire set) is screwed in the second part 72 of the second accessory 7, and the sign post 95 is thus fixed to the ground 93.

Alternatively, the joint device 9 is fixed to the basis 99 without the sign post 95, and the sign post may be connected to the second member 2 after the joint device 9 has been screwed to the basis 99.

Therefore, a sign means 91 is obtained according to which the joint device 9 is interposed between the sign post 95 and the basis 99, whereby a bending or tilting of the sign post 95 with respect to the ground 93 is enabled.

Owing to the spring force of the spring 40, the sign post 95 typically is held in a substantially vertical position. The first member 1 and the second member 2, namely, are forced towards the first alignment position. The use of disk springs or disk spring packages guarantees, in particular, a substantial stability and the sign post basically remains in a vertical position, also under the influence of wind or under the influence of forces, which may be ascribed to a person leaning on the post.

In case a vehicle 96 hits the sign post 95 with a sufficient force, the second member 2 tilts with respect to the first member 1 in that it moves towards the second angular position, and the sign post 95, therefore, assumes an inclined position. In case the vehicle 95 clears away, the spring 40 then brings both members 1, 2 into a position aligned with respect to each other, and, therefore, the sign post 95 is forced elastically towards the vertical position. In other words, the vertical position of the post 95 is automatically restored without the post 95 having undergone any damages which could be ascribed to the impact of the vehicle 96. The bending of the post 95, therefore, is of reversible nature.

Owing to the above, the costs for maintenance are substantially reduced, because the post does not stay bent, is not damaged, and, therefore, does not have to be replaced.

In the embodiment shown, the first member 1 and the second member 2 are located outside the ground 93, i.e., the entire joint device 9 is located above the level of the ground 93. This is advantageous for the device which requires a very simple basis, and also for the maintenance in a case where the replacement of the joint device 9 would be necessary. Specifically, it is sufficient to screw the sign post 95 and/or the joint device 9 without having to interfere with the basis.

Moreover, should it be necessary to temporarily remove the sign post (e.g., for a motorcade with extraordinary dimensions passing through or in case of temporal traffic signs which have to be removed or which frequently have to be changed), the removal can be performed within a short time period by simply screwing the entity post/joint device off from the second fixation accessory 7.

The joint device 9 allows a removal, a replacement, or a re-installation of the sign post 95 within short time without any damage of the traffic sign means 91 and leaves the basis 99 untouched.

The fact that the joint device 9 completely is outside the ground has the advantage that the linkage 3 and the restoring means 4 are protected from dirt, mud, soil, water which otherwise could accumulate in the device 9, and could impede the operation or the lifetime.

The arrangement of the spring 40, i.e., a bulky component, in the second member 2 which is removable from the ground 93 is advantageous in order to bring the hinge axis defined by the linkage 3 preferably into the vicinity of the ground 93 by, however, at the same time leaving the joint device 9 outside the ground. It should be emphasized that the length required for the first member 1 is far below the length required for the second member 2.

The subject-matter of the present invention also allows for configuring a traffic sign means of common type 910 reversibly flexible (i.e., to configure it tiltable) whereby a sign post 950 having a basis portion which is embedded in the ground, and according to which the post already is bent due to an impact (FIG. 13) is augmented by the joint device according to the invention.

The procedure during installment provides for the sign post 950 to be cut above the ground 93 (cutting line 90 in FIG. 13), whereby a sign post portion 95 and a basis 99 are maintained or remain untouched, which is formed by the part of the basis portion which remained embedded in the ground 93.

By following the steps described above, a joint device 9 is connected to the ground 95*a* of the post portion 95 e.g. via a first fixation accessory 6. The joint device 9, moreover, is connected to the basis portion 99 e.g., via a second fixation accessory 7. Thus, a flexible traffic sign means is obtained, whereby it may be started from a common means 910 already installed, without the necessity of intruding the basis or casting a new basis. Namely, as basis, a portion 99 of the existing post 950 is used which already is fixed to the ground 93.

FIG. 14 shows a side view of a section of the joint device from FIG. 1 with an intermediate piece 100, whereby the intermediate piece 100 may be arranged between the first member 1 and the second fixation accessory 7. The intermediate piece 100 at the top side has an internal threading with which the external threading 18 of the first member 1 engages. At the lower side, the intermediate piece 100 has an external threading which is brought into engagement with the internal threading 76 of the second fixation accessory 7. The intermediate piece 100, thus, may be arranged in a simple manner by screwing between the intermediate piece 100 and the first member 1.

The external diameter of the intermediate piece 100 basically corresponds to the external diameter of the first member 1 or the external diameter of the second member 2.

The intermediate piece 100 in the embodiment shown here has a radially circumferential predetermined breaking point 101 which here is arranged slightly below the internal threading. The predetermined breaking point guarantees for the joint device and/or the sign post not being damaged due to a strong bending or due to a strong inclination. Rather, the intermediate piece 100 due to a strong bending or due to a strong inclination, opens along the predetermined breaking point 101 such that only the intermediate piece 100 has to be replaced.

Further, in FIG. 14 an anti-turn locking device is shown. The anti-turn locking device is formed by two undulated regions of the first member 1 and the second member 2 which correspond to each other. The ring face 11 at the upper end of the first member 1 is formed in a slightly undulated manner (serrated edge) for this purpose. The lower pipe end 21 of the second member also is configured slightly undulated (serrated edge) whereby the regions 11 and 21 basically have the same wave shape.

It is advantageous if the wave shapes have a substantially irregular course in radial direction such that the ring face 11 of the first member and the lower pipe end 21 of the second member preferably correspond to or engage each other in exactly one position of the first member with respect to the second member. Thereby it is guaranteed that a sign post erected again after tilting still returns to its correct initial position, and does not tilt up in a twisted position with respect to the first member.

FIG. 15 shows the joint device from FIG. 14 whereby the second member 2 has been rotated by a certain angle with respect to the first member 1 (*a*), and whereby the second member 2 corresponds to the first member 1 with respect to the rotation angle.

During tilting of the second member 2 with respect to the first member 1 or during tilting up of the second member 2, the second member 2 may be turned around its longitudinal axis (if the sign post, for example, has been hit from the side) such that the second member 2 is rotated with respect to the first member 1. This state is shown in figure (a) of FIG. 15. Here, it can be seen that the ring face 11 at the upper end of the first member 1 which is configured in waves does not correspond to or engage with the pipe end 21 configured in waves of the second member 2.

Due to the restoring force of the restoring means 4 and specifically due to the slightly undulated configuration of the ring face 11 and the pipe end 21 it is guaranteed that the second member 2 returns to its original position with respect to the first member by the restoring force of the restoring means 4 effecting a rotation of the second member 2 about its longitudinal axis until the ring face 11 corresponds to the pipe end 21 or has been brought into engagement completely. In other words, due to the restoring force, with a first member 1 rotated with respect to the second member 2, the "mountains" of the undulated pipe end 21 slide into the "valleys" of the undulated ring face 11. This state is shown in figure (b) of FIG. 15.

By means of the anti-turn locking device it is guaranteed that a traffic sign attached to a re-erected sign post always has the correct direction.

According to an alternative embodiment, mirror-inverted to that one illustrated in the figures, the storing space for the elastic element is recessed in the first member or in the basis member which has a tubular shape while the deforming member is connected to the second member of to the upper member via a chain.

The subject-matter of the present invention has now been described with reference to the preferred embodiments. Of course, also further embodiments may exist which are covered by the same spirit of the invention which all are comprised in the same scope of protection of the subsequent claims.

The invention claimed is:

1. A joint device (9) for mounting a sign post (95) or the like, comprising a first member (1) for connection to a basis (99) for the sign post (95), a second member (2) for connection to a base portion (95*a*) of the sign post (95), and a linkage (3) connecting the first member (1) to the second member (2) via which the second member (2) is movable between a first angular position and a second angular position with respect to the first member (1), wherein the first angular position is a position according to which the first member (1) basically has the same alignment as the second member (2), and wherein the second angular position is a tilted position of the second member (2) with respect to the first member (1), wherein the joint device (9) comprises a biased restoring means (4) configured to press the first member (1) and the second member (2) into the first angular position, wherein the biased restoring means (4) comprises an elastic element (40) and a deforming element (45) for cooperation with the elastic element (40) during a movement between the first angular position and the second angular position, wherein the elastic element (40) has a first end (41), a second end (42) facing away from the first end (41), and a continuous cavity (43) which extends between the first end (41) and the second end (42), wherein an interior storage space (25) has a mounting area (26) for the first end (41) of the elastic element (40), wherein the deforming element (45) has a shaft (46) arranged through the continuous cavity (43) of the elastic element (40), and a head (47) resting on the second end (42) of the elastic element (40), wherein the head (47) in the second angular position is closer to the mounting area (26) than in the first angular position.

2. The joint device (9) of claim 1 wherein the first member (1) or the second member (2) has a substantially tubular shape which has an interior storing space (25) for accommodating the elastic element (40).

3. The joint device (9) of claim 1, wherein the deforming element (45) is configured for deforming the elastic element (49) under compression, whereby the elastic element (40) is maximally compressed in the second angular position with respect to the first angular position.

4. The joint device (9) of claim 1, wherein the elastic element comprises a disk spring (40) or a series of disk spring packages.

5. The joint device (9) of claim 1, wherein the head (47) is connected releasably to the shaft (46).

6. The joint device (9) of claim 1, wherein the linkage (3) comprises a chain (30) having a plurality of rings (31, 32, 33), wherein a first ring (31) is connected to the first member (1), and the second ring (32) is connected to the deforming member (45).

7. The joint device (9) of claim 6, wherein the chain (30) has exactly two rings (31, 32).

8. The joint device (9) of claim 1, wherein the linkage (3) is configured to tilt the second member (2) in an arbitrary direction with respect to the first member (1).

9. The joint device (9) of claim 1, comprising a first fixation accessory (6) having a first part (61) connectable to the base portion (95*a*) of the sign post (95), and a second part (62) connectable to the upper end of the second member (2).

10. The joint device (9) of claim 1, comprising a second fixation accessory (7) having a first part (71) connectable to a basis (99) for the sign post (95), and a second part (72) connectable to the ground (15) or at a lower portion of the first member (1).

11. The joint device (9) of claim 9, wherein the first part (61, 71) of the fixation accessory (6, 7) is provided with a straddling means (64, 74), and wherein the second part (62, 72) of the fixation accessory (6, 7) is provided with a threading (66, 76).

12. The joint device (9) of claim 1, wherein an interior storage space (25) for accommodation of the elastic element (40) is recessed in the second member (2), wherein the second member (2) has a substantially tubular shape.

13. The joint device (9) of claim 1, wherein the second member (2) has a larger diameter in an upper portion than in a lower region.

14. The joint device (9) of claim 13, wherein the inner diameter in the upper region of the second member (2) basically corresponds to the external diameter of the elastic element (40).

15. The joint device (9) of claim 1, wherein the first member (1)

has a substantially cylindrical shape, and/or has in a lower region a threading, and/or has an axial recess, preferably a continuous and axial aperture, in which at least one ring of the chain (30) is arrangeable.

16. The joint device (9) of claim 1, wherein the first member (1) has a radial boring, preferably a blind hole, into which a fastening bolt (36) is insertable.

17. The joint device (9) of claim 1, wherein the upper end of the first member (1) in radial direction is configured in an undulated manner, wherein the lower end of the second member (2) in a radial direction is configured in an undulated manner, and wherein the ends configured in an undulated manner together and by means of the biasing force form an anti-turn locking means.

18. The joint device (9) of claim 17, wherein the undulated shape of the first member (1) basically is identical to the undulated shape of the second member (2), and wherein the undulated shapes of the first member and the second member in radial direction have a regular or an irregular shape.

19. The joint device of claim 1, further comprising at least one predetermined breaking point (101).

20. The joint device (9) of claim 19, wherein the predetermined breaking point (101) is provided at or in an intermediate piece (100), which is arranged between the first member (1) and the basis (99) for the sign post (95), preferably between the first member (1) and the second fixation accessory (7).

21. The joint device (9) of claim 19, wherein the predetermined breaking point (101) is provided at or in an intermediate piece (100), which is arranged between the second member (2) and the sign post (95), preferably between the second member (2) and the first fixation accessory (6).

22. A system comprising a sign post (95) or the like, and a joint device (9) of claim 1, wherein the second member (2) of the joint device (9) is connected to a base portion (95*a*) of the sign post (95).

23. The system of claim 22, wherein the joint device (9) has a cross section having a shape and dimensions which are equal to the shape and the outer dimensions of a cross section of the sign post (95).

24. A sign means (91) or the like, comprising a basis (99) which at least partially is inserted into the ground (93), and a system of claim 22, wherein the first member (1) of the joint device (9) is connected to the basis (99), and wherein the joint device (9) is interposed between the sign post (95) and the basis (99), whereby the sign post (95) is adapted to perform a reversible flexion with respect to the ground (93), wherein the flexion is a movement between a substantially vertical position and an inclined position, and the sign post (95) is pressed elastically towards the substantially vertical position.

25. The sign means (91) of claim 24, wherein the first member (1) and the second member (2) are located outside of the ground (93).

26. A method for forming a sign means (910) or the like, wherein the sign means (910) comprises a sign post (950) or the like having a base portion inserted into a ground (93), wherein the method comprises at least the following steps:

cutting the sign post (950) above the ground (93) while maintaining a portion of the sign post (95) and a basis (99), wherein the basis (99) comprises the base portion inserted into the ground;

providing a joint device (9) of claim 1;

connecting the first member (1) of the joint device (9) to the basis (99) and connecting the portion of the sign post (95) to the second member (2) of the joint device (9) while maintaining a sign means (91) in which a sign post (95) is reversibly flexible with respect to the ground (93) between a substantially vertical position and a tilted position, wherein the sign post (95) is pressed towards the substantially vertical position elastically.

27. The method of claim 26, wherein the portion of the sign post (95) is connected to the second member (2) of the joint device (9) while interposing a first fixation accessory (6) and/or wherein the first member (1) of the joint device (9) is connected to the basis (99) while interposing a second fixation accessory (7).

28. The method of claim 26, wherein the connection is carried out while interposing an intermediate piece (100) which has a predetermined breaking point (101).

* * * * *